US008220451B2

(12) United States Patent
Miwa et al.

(10) Patent No.: US 8,220,451 B2
(45) Date of Patent: Jul. 17, 2012

(54) GELLING AGENT HEATING UNIT

(75) Inventors: Yoshihiro Miwa, Aichi-ken (JP); Kazuhiro Kashiwagi, Tokyo (JP)

(73) Assignee: Kowa Company, Ltd., Aichi-Ken (JP)

( * ) Notice: Subject to any disclaimer, the term of this patent is extended or adjusted under 35 U.S.C. 154(b) by 491 days.

(21) Appl. No.: 12/474,900

(22) Filed: May 29, 2009

(65) Prior Publication Data

US 2010/0229848 A1 Sep. 16, 2010

(30) Foreign Application Priority Data

Mar. 11, 2009 (JP) ..... 2009-057478

(51) Int. Cl.
*F24J 1/00* (2006.01)

(52) U.S. Cl. ..... 126/263.02; 126/263.01

(58) Field of Classification Search ..... 126/263.02, 126/263.01, 204
See application file for complete search history.

(56) References Cited

U.S. PATENT DOCUMENTS

| | | | | |
|---|---|---|---|---|
| 2,589,645 | A * | 3/1952 | Tiegel | 126/263.02 |
| 5,125,392 | A * | 6/1992 | Hardwick | 126/263.02 |
| 7,950,385 | B2 * | 5/2011 | Ohnishi et al. | 126/263.01 |
| 2007/0157921 | A1 * | 7/2007 | Rankin | 126/263.01 |

FOREIGN PATENT DOCUMENTS

| | | |
|---|---|---|
| JP | 63-34437 | 3/1988 |
| JP | 4-58226 | 5/1992 |

* cited by examiner

*Primary Examiner* — Alfred Basichas
(74) *Attorney, Agent, or Firm* — Duane Morris LLP

(57) ABSTRACT

Projections are located at an inner face of a case member so as to form air passages in first and second directions. A disposable pocket heater and a gel container are set inside the projections and the case member is assembled. Since the air passages in both directions are formed on a whole surface of the disposable pocket heater, oxygen is supplied to the whole disposable pocket heater and the whole gelling agents in the gel container is heated to almost uniform temperature.

5 Claims, 5 Drawing Sheets

GELLING AGENT HEATING UNIT

CROSS REFERENCE TO RELATED APPLICATION

The present disclosure relates to subject matter contained in Japanese patent application No. 2009-57478 filed on Mar. 11, 2009, the disclosure of which is expressly incorporated herein by reference in its entirety.

BACKGROUND OF THE INVENTION

This invention relates to a gelling agent heating unit for heating gelling agent with a portable heating element.

In the past, various kinds of portable heaters with no external power have been proposed. For example, there is a portable heater with a disposable pocket heater for heating milk at the outside (see Japanese patent application publication No. S63-34437).

There may be some case where it is necessary to heat a gelling agent at a place having no external power. For example, in a medical field, an ultrasonic testing is generally executed. In such a testing, a gelling agent (gel for ultrasonic testing) is used in order to improve an efficiency of ultrasound transmission between a body surface of an examinee and an ultrasonic probe. It is preferable to heat such gel for ultrasonic testing in advance in order not to give uncomfortable feeling to an examinee (concretely speaking, 35° C. to 40° C.). In recent years, a battery drive type of an ultrasonic testing unit with no external power exists on the marketplace (such as MicroMaxx series by SonoSite Inc.), through which a doctor can execute ultrasonic testing at a patient's home having no external power. But, no proper heating unit for ultrasonic testing gel which has no external power has not yet been proposed. A method of heating gel for ultrasonic testing by driving a battery is not practical because of high power consumption. If a conventional unit for heating liquid is used for heating a gelling agent, it is not possible to uniformly heat the gelling agent since the gelling agent is low in fluidity in comparison with liquid, such as milk. In order to uniformly heat a gelling agent, a person may crumple a gel container for a predetermined time, but in fact, such a work is troublesome.

An object of the invention is to provide a gelling agent heating unit for solving the above-mentioned inconveniences.

SUMMARY OF THE INVENTION

One aspect of the invention exemplarily shown in FIGS. 1(*a*), (*b*), is a gelling agent heating unit, comprising:

a case member for storing a gel container having gelling agents therein and a portable heating element which can heat without receiving power supply from an outside, said portable heating element being inserted between said case member and an outside surface of said gel container; and projections which are located at portions between said stored portable heating element and said case member where said projections partially contact with said portable heating element so as to reduce a degree of close contact between said portable heating element and said case member when said portable heating element is stored in said case member;

whereby said projections form a first air passage in a first direction along said stored portable heating element by extending said projections in said first direction, and form a second air passage in a direction along said stored portable heating element, a second direction almost perpendicular to said first direction.

Besides, other aspect of the invention is the gelling agent heating unit, wherein said second direction is almost parallel to a longitudinal direction of said gel container which is stored in said case member.

Furthermore, another aspect of the invention is the gelling agent heating unit, wherein said two or more projections extend in said first direction, and are located in rows in said second direction, being separated in a part.

In addition, another aspect of the invention is the gelling agent heating unit wherein said case member has almost an cylinder shape and has an adjustment member for adjusting its diameter.

Besides, another aspect of the invention is the gelling agent heating unit, wherein said portable heating element is a disposable pocket heater.

According to these aspects of the invention, it is possible to provide the heating unit which is light and small and superior in its portability in comparison with a conventional external power type, in order to heat gelling agents in a gel container with no external power. And, the air passages are formed at the surface of the stored portable heating element in both the first and second directions, so that it is possible to supply almost the whole heating element with oxygen necessary for heating the portable heating element and to heat the gelling agents in the gel container to an almost uniform temperature.

If the disposable pocket heater on the market (which is not a paste type, but one storing iron powders in an air-through bag) is used as the portable heating element, the iron powders freely move in the air-through bag and gather at the bottom portion of the bag. Then, the pocket heater heats at only the bottom portion. In case of liquid, such as milk, the temperature of milk is totally made equal because of its fluidity even in partial heating. But, in case of gelling agent, it is hard to totally make the temperature of the whole gelling agent equal because of its small fluidity. When the temperature of the gelling agents which are pushed out of the gel container may be high or low, the examinee may feel discomfort. On the contrary, according to the invention, the gelling agents can be made almost equal by blocking the iron powders by the projections in each row so as to save partial gathering of the iron powders and subsequent partial heating.

The gel container may have many thickness. According to the invention, the diameter of the case member is adjustable by the adjustment member, and a space between the gel container and the case member can be made proper in order to effectively heat the gel container thereby.

BEST MODE FOR CARRYING OUT THE INVENTION

An embodiment of the invention is now mentioned, referring to appended FIGS. 1 through 5.

Figure 1:
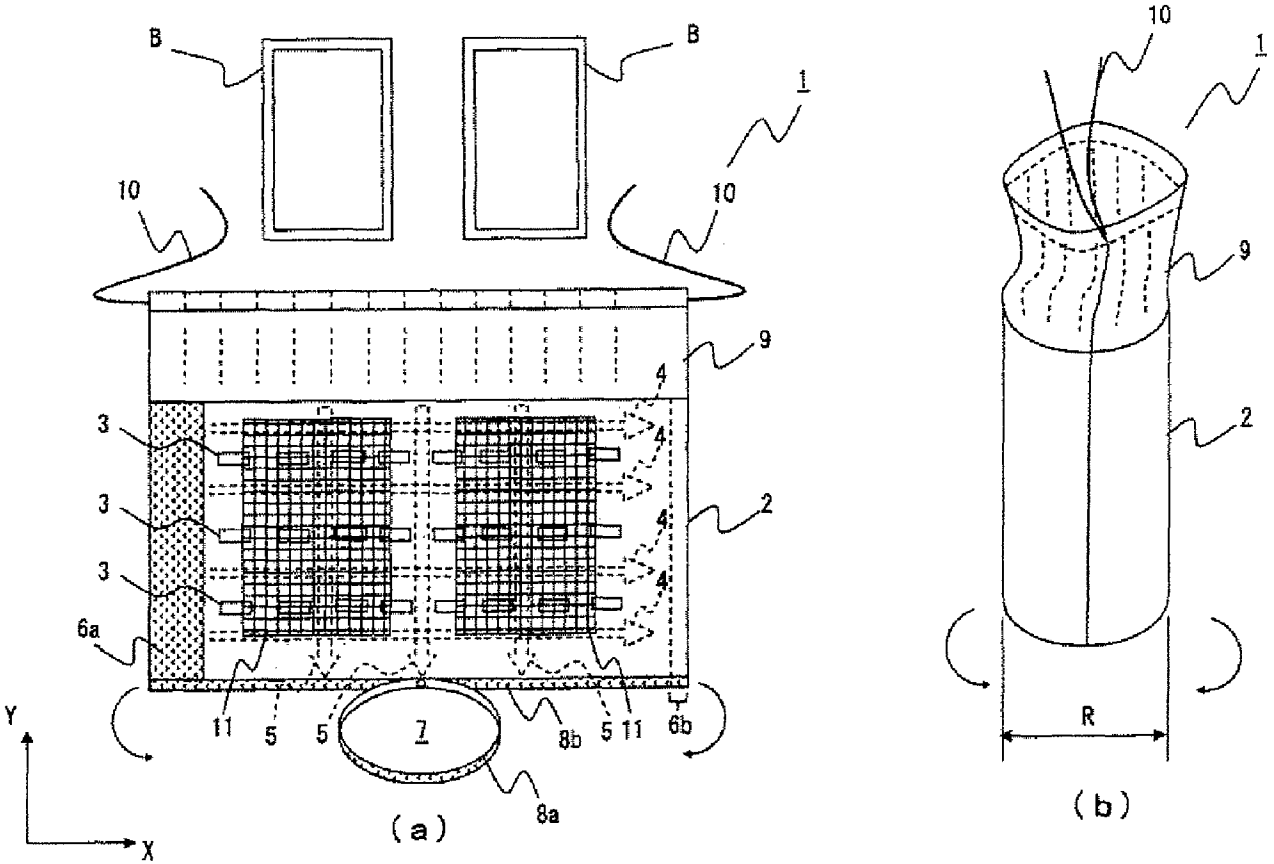
FIG. 1(*a*) is a front view which shows an example of a structure of a gelling agent heating unit according to the invention (a developed state), and FIG. 1(*b*) is a perspective view which shows an example of an appearance of the gelling agent heating unit according to the invention (an assembled state).
Figure 2:
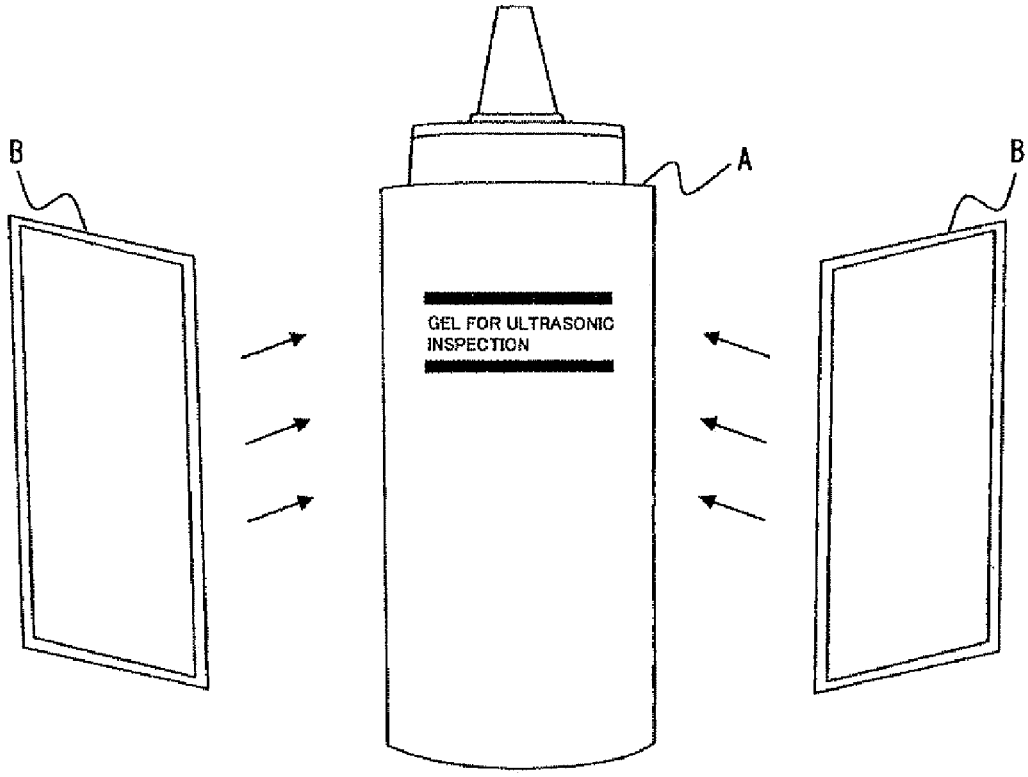
FIG. 2 is a front view of portable heating elements which shows a gel container also.

A gelling agent heating unit 1 according to the invention which is denoted with a reference number 1 in FIG. 1(*a*) and FIG. 1(*b*) has a case member 2 for storing a gel container (denoted with a reference number A of FIG. 2) which stores a gelling agent. Such a case member 2 is formed so as to store a portable heating element B between the case member 2 and an outer surface of the stored gel container 4. "The portable heating element" in the specification means a disposable pocket heater, for example, which can be heated without receiving power supply from the outside. In addition, the gelling agent is a gel for ultrasonic testing, for example.

Between the portable heating element B to be stored and the case member 2, projections 3 are located so as to partially contact with the portable heating element B. Since the projections 3 are partially contacted with the stored portable heating element B, a degree of contact between the portable heating element B and the case member 2 is rather low at least in neighborhoods of locations of the projections 3 if the portable heating element B is stored in the case member 2. Concretely speaking, the projections 3 are provided so as to extend in a direction along the portable heating element B to be stored ("the first direction" hereinafter which is a direction X almost parallel to a peripheral direction of the gel container which is stored in the case member 2), and air passages 4 ("the first air passages" hereinafter) along the direction X are formed at least in neighborhoods of the projections 3. In addition, the projections are partially divided, so that air passages 5 ("the second passages" hereinafter) are formed in a second direction (the direction along the portable heating element B to be stored which is almost orthogonal to the first direction X).

The heating unit 1 according to the invention has the above-mentioned structure, and is light, small and superior in its portability in comparison with a conventional external power type. A trial heating unit which was used by the inventors is light and the main body thereof is 60 g or so, and the heating unit storing the portable heating element therein with no gel container is 150 g or so. In addition, the heating unit 1 can heat the gelling agent in the gel container A with no external power. Since the air passages are formed in both directions, the first and the second directions at surfaces of the portable heating elements B which are stored, oxygen necessary for heating the portable heating element B can be supplied to almost the whole heating element B, so that the gelling agent in the gal container can be heated to almost uniform temperature.

Preferably, the projections 3 having the above-mentioned structure (that is, the projections 3 extending in the first direction X and being separated in a part) are located in a plurality of rows (in three rows in FIG. 1(*a*)) in the second direction Y. Their effects are now described.

A disposable pocket heater on the market is used as the portable heating element B in this embodiment, and such disposable pocket heater is not a paste type but is one storing iron powders in an air-through bag. In such type of heater, iron powers freely move in the air-through bag, so that the iron powders gather in a bottom portion of the bag and the disposable pocket heater are heated only in the bottom portion, partially thereby. In case of liquid, such as milk, even if milk is partially heated, milk flows and is uniformly heated. On the other hand, in case of a gelling agent, it is hard to equalize the temperature of the whole gelling agent because of its low fluidity. An examinee may have discomfort feelings if the temperature of the gelling agent which is pushed out of the gel container is rather high or rather low. If the projections 3 are located in a plurality of rows as mentioned before, but, the projections 3 in each row block flow of the iron powders, so that partial gathering of the iron powders and succeeding partial heating can be prevented. Then, the gelling agent can be heated to an almost uniform temperature.

Preferably, the above-mentioned case member 2 may be almost cylindrically (circular cylinder or square cylinder) formed at least when storing the gel container A as shown in FIG. 1(*b*). In addition, a member for adjusting a diameter (R in FIG. 1(*b*)) of the case member 2 ("the adjustment member" hereinafter), such as reference numbers 6*a* and 6*b* in FIG. 1(*a*) may be provided at the case member 2. There are various sizes of the gel containers A. If the diameter R of the case member 2 is adjusted according to the thickness of the gel container A, a spacing between the gel container A and the case member 2 can be made proper and the gel container A can be effectively heated. Such an adjustment member is a magic tape (registered trademark), for example. The magic tape 6*a* shown in the figure is attached to an inner face of the case member, having a rather wider width than a normal one. And, the other magic tape 6*b* is attached to an outer surface of the case member. When positions to be attached of both magic tapes 6*a*, 6*b* are changed, it is possible to properly adjust the diameter R of the case member 2 at the time of storing the gel container A.

It is preferable to make the diameter of the case member sufficiently big (in comparison with the diameter of the gel container) by functions of the adjustment members 6*a*, 6*b* so as to easily attach and detach the gel container A or the portable heating element B to and from the case member 2. Preferably, the case member 2 maybe developed as shown in FIG. 1(*a*) (that is, the case member may be made one sheet, not circular shape). When the case member 2 can be developed, it is easy to attach and detach the gel container A or the portable heating element B to or from the case member 2. A reference number 7 in FIG. 1(*a*) denotes a member for preventing heat escape from the bottom side of the gel container A by closing such bottom portion ("the bottom plate member" hereinafter), and a reference number 8*a* denotes a magic tape attached to an outer peripheral face of the bottom plate member 7, and the reference number 8*b* denotes a magic tape attached to the case member side 2 for connection with the bottom plate member 7. And, a reference number 9 denotes a member for preventing heat escape from an opening portion of the gel container A (the side of the opening through which the gelling agent is pushed out) ("the lid member" hereinafter). The lid member 9 as shown in the figure is formed in a pouch shape, and the opening of the lid member 9 can be closed by a string member 10.

A heating body storing portion 11 for storing the portable heating element B may be provided at an inner side of the case member 2. Preferably, this heating body storing portion 11 is one having a structure so as not prevent a heat conduction from the portable heating element B to the gel container A, such as a mesh-shaped one and one made of metallic fibers having a high heat conductivity. The gelling agent heating unit 1 as shown in FIG. 1(*a*) has two heating body storing portions 11 through which two portable heating elements B can be stored, but may store only one portable heating element B, or three or more elements.

A method for dealing with the heating unit as shown in FIG. 1(*a*) (in which the case member 2 can be developed and which has the heating body storing portion(s) 11) is now described.

In order to set the gel container A, the case member 2 is developed as shown in FIG. 1(*a*), and the portable heating element B is stored in the heating body storing portion 11. And, the gel container A is put on the heating body storing portion 11, and the case member 2 is made a cylindrical shape (a state as shown in FIG. 1(*b*)). At this time, the bottom palate member 7 is connected with the case member 2 so as to close the bottom opening of the member 2, and the portion of the opening of the lid member 9 is closed by the string member 10. If the disposable pocket heater is used as the portable heating element B, it is necessary to crumple the disposable pocket heater so as to start an exothermic reaction. Such crumpling operation of the disposable pocket heater may be executed before or after storing the heater in the heating body storing portion 11. In addition, the number of the portable heating elements B to be set may be properly adjusted. If it is used in a high temperature season or place, for example, the number thereof may be small. If it is used in low temperature season or place, many heating elements B may be provided. Alternatively, many portable heating elements B (two, for example) may be set at the time of starting to heat the gel container A, and the number of the portable heating elements B may be reduced (one, for example) in a heat reserving state.

Preferably, the above-mentioned case member 2 is made of a material having high resisting property, high heat retaining property or high flexibility, such as sheets laminated with nylon sheets or aluminium sheets for heat reserve. If the case member 2 is made of the material having high flexibility, it is possible to crumple the portable heating element B so as to start an exothermic reaction or to press and push the gel container A from the outside of the case member 2, so that it is not necessary to take the gel container A from the case member 2.

The projections 3 as shown in FIG. 1(*a*) are formed by a plurality of projection pieces in the shape of rectangular parallelopiped, which are successively located in a direction (the first direction X), but the shape or the position to be located of each projection piece may be properly changed. Preferably, the projection 3 is made of proper material, such as gums and fibers. In addition, an air passage may be provided between the gel container A and the portable heating element B by forming a convex portion on a surface of the gel container A in order to supply the portable heating element B with air.

An inside pocket (not shown) for inserting a temperature gauge may be provided at an inner face of the case member 2 so as to measure the temperature of an inside of the case member. And, an alarm for informing warning at the time of exceeding a predetermined temperature may be provided.

Figure 3:
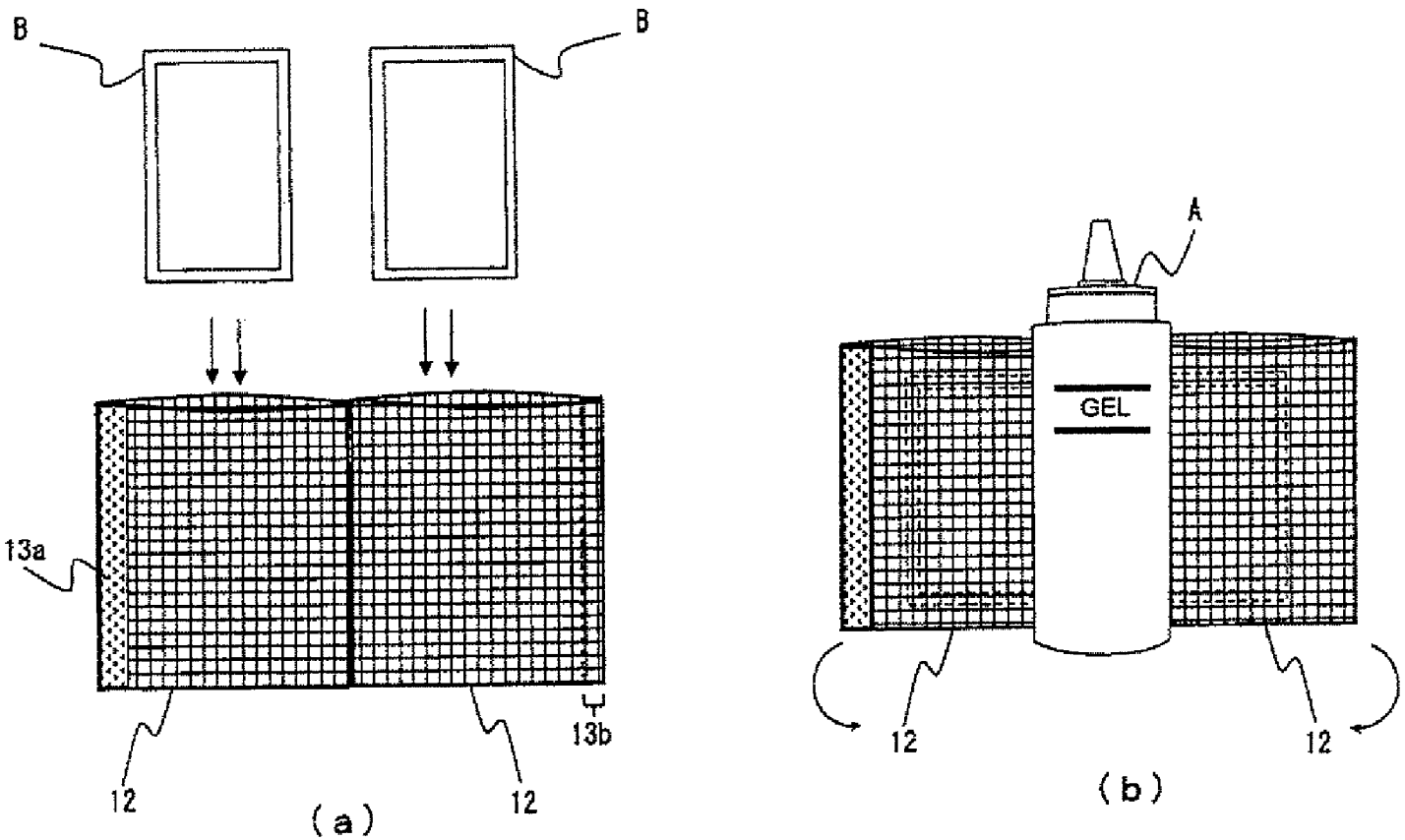
FIG. 3(*a*) is a front view which shows a structure of a heating body storing portion, and FIG. 3(*b*) is a front view which shows an attachment of the heating body storing portion to the gel container.

The heating unit 1 as shown in FIG. 1(*a*) has the heating body storing portions 11 at the inner face of the case member 2, but does not always have such portions. For example, the heating body storing portion may be one in the shape of a bag as shown in FIGS. 3(*a*), (*b*) denoted with an reference number 12 (which is an independent member which is not attached to the case member 2, such as a bag made of meshes) and connection members 13*a* and 13*b*, such as magic tapes, are provided in advance, and the storing portion 12 may be wound on the gel container A as shown in FIG. 3(*b*). In such a case, the case member which has the projections 3 on the inner face thereof but has no heating body storing portion 11 (not shown) is used, not one as shown in FIG. 1(*a*), and the gel container A may be stored in the case member in such a state that the heating body storing portion 12 and the portable heating element B are wound on the gel container A. There are an attachment type of the disposable pocket heaters on the market, and such a heater has an adhesive portion through which the heater can be attached to a body surface. On the assumption that only such attachment type of the disposable pocket heater is used, no heating body storing portion 11, 12 may be provided. If the attachment type of the disposable pocket heater is used, it is preferable to provide concave and convex portions on the surface of the gel container A (especially, the portion to which the disposable pocket heater is attached) in order to reduce an area of the pocket heater to be adhered. In such a case, a sticking condition between the disposable pocket heater and the gel container A is lightended and the gel container A is easy to be transformed if pushed thereby. Then, a pushing operation of the gelling agent is smoothly executed.

A first embodiment of the invention is now described, referring to FIGS. 1 to 4.

In this embodiment, the gelling agent heating unit 1 as shown in FIGS. 1(*a*), (*b*) was used. And, two structures each storing iron powders in an air-through bag ("Eco Pokka" (registered trademark) made by The Hosho Corporation) were used as the portable heating elements B, and "AQUASONIC 100" produced by Parker Laboratories, INC. was used as the gel container A storing gelling agents. According to a measurement of the temperature of the gelling agent under an external temperature (environmental temperature) 22° C., the temperature increased as shown by a full line of FIG. 4, and reached a proper temperature 35° C. (the temperature through which an examinee does not feel discomfort) within one hour and a half or so. A broken line shows the temperature change with the external power type of the gelling agent heating unit ("JW-2000 made by ALOKA CO., LTD.), and it was found that the temperature rise by the unit according to the invention is on almost the same level as the external power type.

Figure 4:
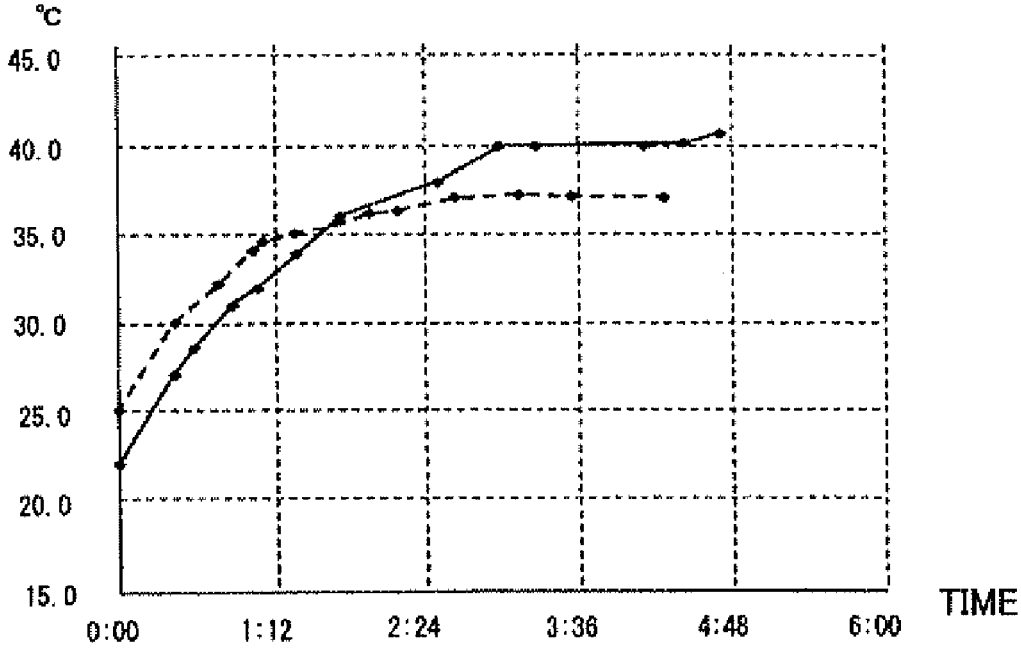
FIG. 4 is a view of an example of thermal hysteresis showing a temperature of the gelling agent which is changed with a passage of time.
Figure 5:
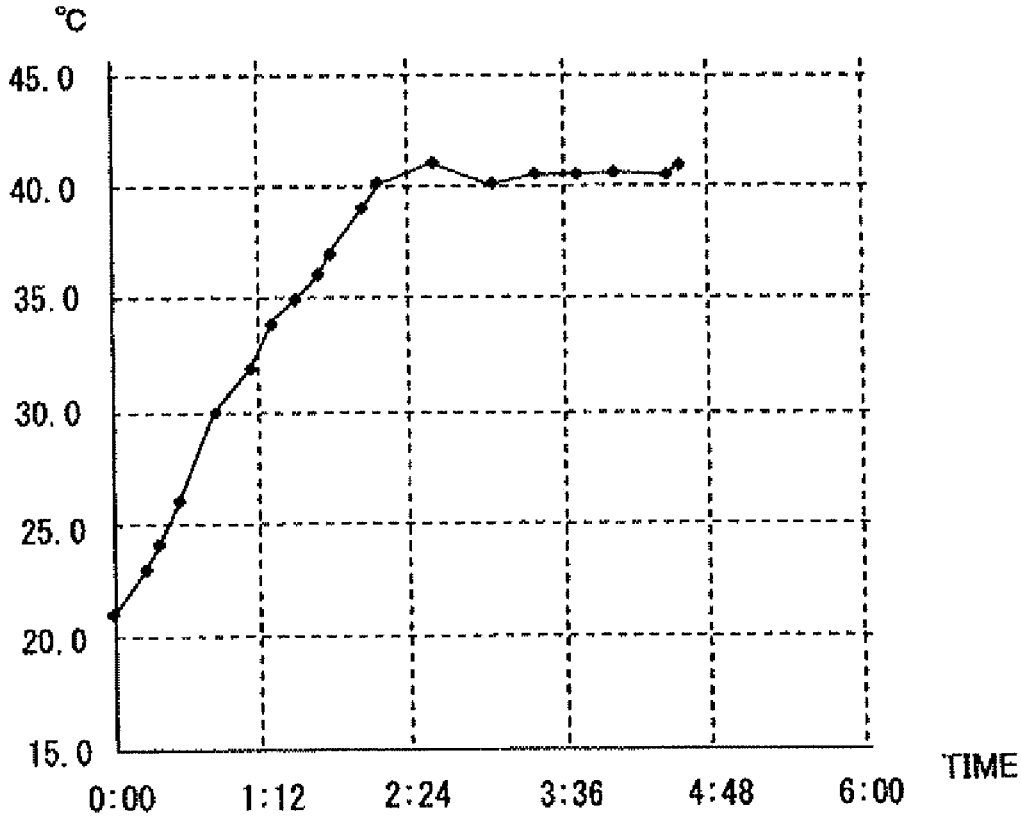
FIG. 5 is a view of the other example of thermal hysteresis showing a temperature of the gelling agent which is changed with a passage of time.

In this embodiment, the gelling agent heating unit 1 (which does not have the heating body storing portion 11) as shown in FIGS. 1(*a*), (*b*), was used, and two paste type of attachable heating elements ("Hokkairo" (registered trademark) to be attached made by Hakugen Co., Ltd.) were used as the portable heating elements B. In addition, "AQUASONIC 100" made by Parker Laboratories, INC. was used as the gel container A including gelling agents. According to the measurement of the temperature of the gelling agent under an external temperature (environmental temperature) 21° C., the temperature increased as shown in FIG. 4, and reached a proper temperature 35° C. (the temperature through which an examinee does not feel discomfort) within about one hour and a half.

The present invention has been explained on the basis of the example embodiment discussed. Although some variations have been mentioned, the embodiment which is described in the specification is illustrative and not limiting. The scope of the invention is designated by the accompanying claims and is not restricted by the descriptions of the specific embodiment. Accordingly, all the transformations and changes within the scope of the claims are to be construed as included in the scope of the present invention.

The invention claimed is:

1. A gelling agent heating unit, comprising:

a case member for storing a gel container having gelling agents therein and a portable heating element which can heat without receiving power supply from an outside, said portable heating element being inserted between said case member and an outside surface of said gel container; and projections which are located at portions between said stored portable heating element and said case member where said projections partially contact with said portable heating element so as to reduce a degree of close contact between said portable heating element and said case member when said portable heating element is stored in said case member;

whereby said projections form a first air passage in a first direction along said stored portable heating element by extending said projections in said first direction, and form a second air passage in a direction along said stored portable heating element, a second direction almost perpendicular to said first direction.

2. The gelling agent heating unit according to claim 1, wherein said second direction is almost parallel to a longitudinal direction of said gel container which is stored in said case member.

3. The gelling agent heating unit according to claim 1, wherein said two or more projections extend in said first direction, and are located in rows in said second direction, being separated in a part.

4. The gelling agent heating unit according to claim 1, said case member has an almost cylinder shape and has an adjustment member for adjusting its diameter.

5. The gelling agent heating unit according to claim 1, wherein said portable heating element is a disposable pocket heater.

* * * * *